US005251755A

United States Patent [19]

Kausch

[11] Patent Number: 5,251,755

[45] Date of Patent: Oct. 12, 1993

[54] PACKAGE HAVING A LEADER SECURED OVER A POUCH

[75] Inventor: Thomas J. Kausch, Rochester, N.Y.

[73] Assignee: Eastman Kodak Company, Rochester, N.Y.

[21] Appl. No.: 969,553

[22] Filed: Oct. 30, 1992

Related U.S. Application Data

[63] Continuation of Ser. No. 802,966, Dec. 6, 1991, abandoned.

[51] Int. Cl.[5] ..... B65D 85/30

[52] U.S. Cl. ..... 206/455; 354/276; 378/182

[58] Field of Search ..... 286/449, 454, 455; 383/35, 93-95; 354/276, 277; 378/182, 188, 169

[56] References Cited

U.S. PATENT DOCUMENTS

| | | | |
|---|---|---|---|
| 1,741,071 | 12/1929 | Peirce | 383/35 X |
| 2,112,816 | 3/1938 | Rulon | 206/455 X |
| 2,974,229 | 3/1961 | Schmidt et al. | 378/169 |
| 3,443,093 | 5/1969 | Lindermuth et al. | 206/455 X |
| 4,192,420 | 3/1980 | Worrell, Sr. et al. | 206/449 X |
| 4,799,591 | 1/1989 | Tajima et al. | 206/455 |
| 4,831,643 | 5/1989 | Tanaka | 378/169 |
| 4,876,706 | 10/1989 | Tajima | 354/277 X |
| 4,909,389 | 3/1990 | Plessers et al. | 206/455 X |
| 4,922,511 | 5/1990 | Gay | 378/169 |
| 4,933,696 | 6/1990 | Schmidt et al. | 354/277 |
| 4,955,479 | 9/1990 | Beer et al. | 206/455 |
| 5,048,685 | 9/1991 | Kausch et al. | 206/455 |
| 5,048,686 | 9/1991 | Kausch et al. | 206/455 |

*Primary Examiner*—Bryon P. Gehman
*Attorney, Agent, or Firm*—Frank Pincelli

[57] ABSTRACT

A package for a stack of film sheets includes a pouch that encloses the stack of film sheets, and a leader that is positioned over a face of the pouch and is secured to a leading edge of the pouch so that the leader remains over the ouch until an operator pulls it away from the pouch and feeds it into a spindle to remove the package from the stack of film sheets.

6 Claims, 3 Drawing Sheets

PACKAGE HAVING A LEADER SECURED OVER A POUCH

This is a continuation of application Ser. No. 802,966 filed Dec. 6, 1991, now abandoned.

BACKGROUND OF THE INVENTION

The present invention relates to a package for enclosing a plurality of sheets of material, such as a stack of x-ray film.

It is known to provide a light tight package for holding a stack of sheets of x-ray film or the like. The package may comprise a pouch or bag for holding the sheets, and a leader that projects from an end of the pouch. Such a film package can be placed in a magazine or cassette having a spindle, and the leader is attached to the spindle. Then the magazine or cassette is closed and the spindle rotated to strip the packaging material from the stack of sheets. Thereafter, the magazine is provided to a laser printer or other apparatus having a light tight compartment wherein the sheets can be removed seriatim for use. Alternatively, the package can be manually opened in a light tight environment and sheets removed and loaded into light tight cassettes of the kind used for making x-rays of patients. Packages and magazines of the kind described above are disclosed, for example, in U.S. Pat. No. 5,019,849, issued May 28, 1991; in U.S. Pat. No. 5,048,686, issued Sep. 17, 1991; and in Italian Patent No. 1,062,043.

A leader on a package of the kind mentioned above sometimes needs to be relatively large in order to reach from the pouch which holds the film sheets to the spindle of the magazine. The leader can be integral with the pouch, or formed separately and secured to the pouch. Either way, the leader projects away from the pouch. Generally, to facilitate shipment and handling prior to placement in a magazine, the leader is folded onto one side of the package and may be secured to that side temporarily by pressure sensitive tape, for example, as disclosed in the before-mentioned U.S. Pat. No. 5,048,686. While this arrangement works satisfactorily, it can create a problem when film is loaded into the package. More specifically, some production equipment has a hopper that holds a stack of empty packages having the end of the pouch opposite from the leader open to receive a stack of film sheets and a film carrier. Because the package leader projects from the pouch, the package does not fit well in the hopper. A better fit to the hopper can be achieved if the package, including the leader, is rectangular in shape. This, of course, must be achieved without adversely affecting the use of the leader in a magazine for pulling the package from the stack of film sheets.

SUMMARY OF THE INVENTION

An object of the invention is to provide a package for sheets of x-ray film or the like wherein the leader is attached to the package so that it is unlikely to be accidentally separated from its normal position along one face of the package, but wherein the leader can be easily extended for attachment to a spindle for removal of the package from a stack of film sheets.

Another object of the invention is to provide a film package which will fit easily into production equipment having a hopper to hold a stack of empty packages.

In accordance with the present invention, a package is provided for enclosing a plurality of sheets of material, such as a stack of x-ray film. The package includes a pouch for enclosing the sheets with the pouch having a first face and a second face located in generally parallel planes. The sheets are positionable between the faces, and the faces are sealed together around the sheets. The pouch has a leading edge and first and second side edges extending from the leading edge. A leader is positioned entirely over the first face of the pouch with the leader having a first edge secured to the leading edge of the pouch and other portions of the leader being free from the first face of the pouch so that the other portions of the leader can be lifted from the pouch for removal of the pouch from the stack of sheets.

The invention and its objects and advantages will become more apparent in the detailed description of the preferred embodiment presented below.

BRIEF DESCRIPTION OF THE DRAWINGS

In the detailed description of the preferred embodiment presented below, reference is made to the accompanying drawings, in which.

DETAILED DESCRIPTION OF THE PREFERRED EMBODIMENTS

Figure 1:
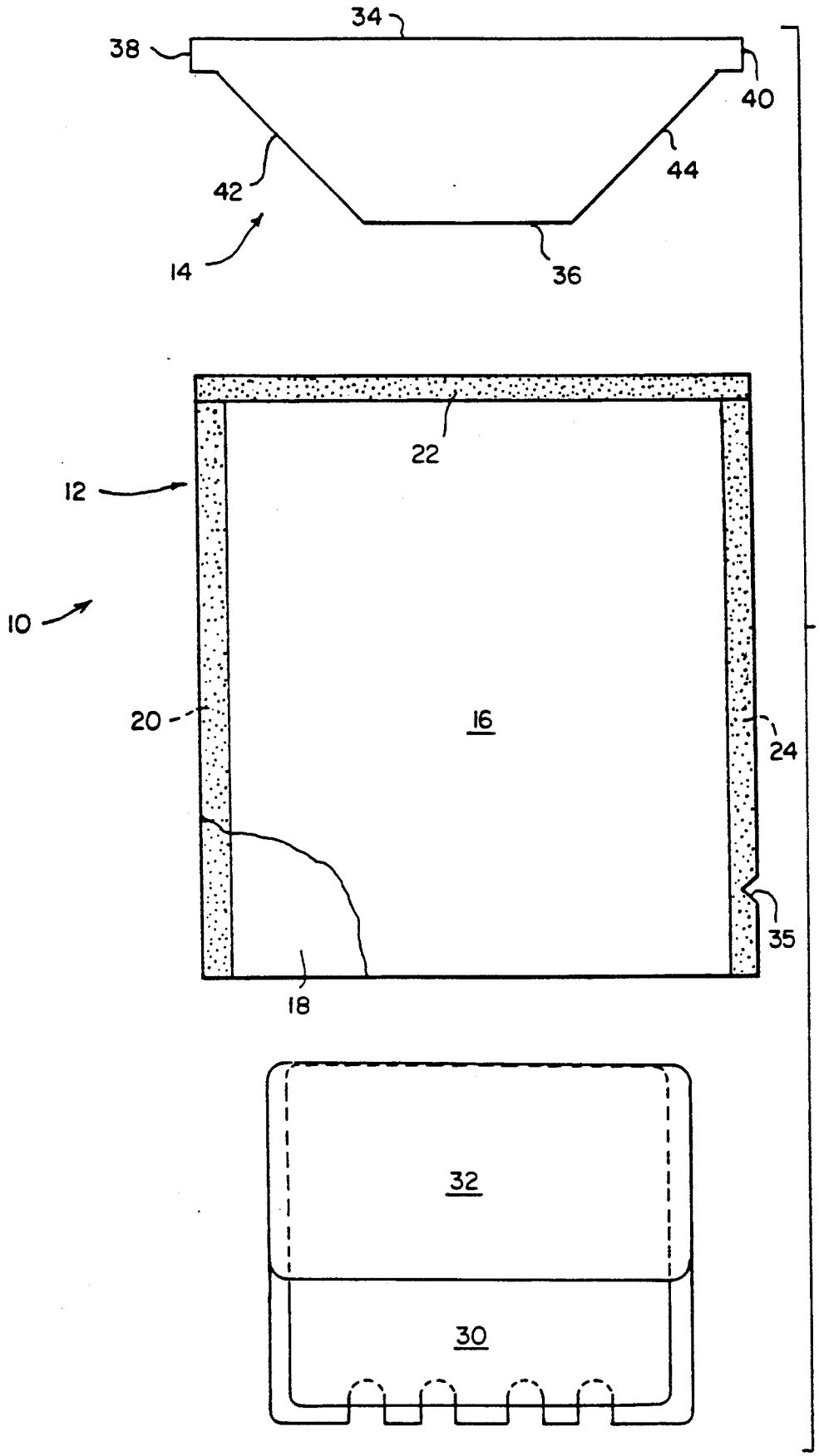
FIG. 1 is an exploded plan view of the package of the invention illustrating the pouch and leader portions of the package prior to attachment of the leader to the pouch and before the stack of film is loaded into the package, and further illustrating a stack of film sheets in a protective carrier positioned for loading into the package.

Referring now to the drawings in detail, a package of the invention is generally designated 10 and comprises a pouch 12 and a leader 14. The pouch can be formed from two generally rectangular sheets 16 and 18 (FIGS. 1 and 3) of packaging material. Various packaging materials are suitable for use in making the package. For example, sheets 16,18 can be cut from a laminate comprising layers of black modified high density polyethylene and a metalized polyester or metalized oriented polypropolene with a heat sealant layer provided, as needed, to enable the sheets to be secured together by heat sealing. The leader can be cut from a sheet of rubber modified high density polyethylene, for example.

The sheets 16,18 are of the same size and are located one above the other in generally parallel planes with the black layers of the sheets facing each other. They are initially secured together along the three side edges thereof, for example by lines of heat sealing designated 20, 22 and 24. Seals 20,24 are at side edges of the pouch while seal 22 is along the top or leading edge of the pouch. Initially, the bottom of the pouch is open, and the stack of film sheets is loaded into the pouch through the open bottom. Then the sheets 16,18 are sealed together at the bottom portion of the pouch by a line of heat sealing 26, for example. This leaves the film in a light tight space 28 (FIG. 3) between the sheets 16 and 18.

Figure 3:
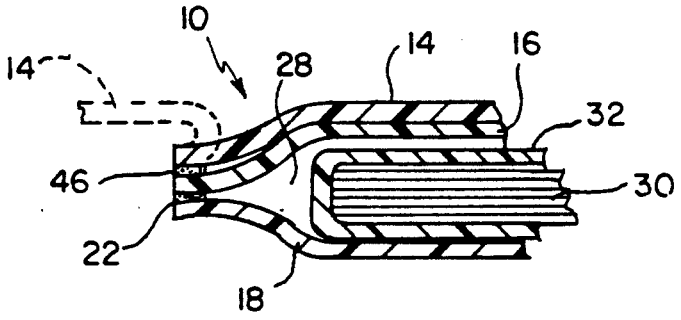
FIG. 3 is an enlarged cross section taken along line 3—3 of FIG. 2.

As best shown in FIGS. 1 and 3, the space 28 receives a stack of film sheets 30, positioned within a U-shaped carrier 32 which protects the film sheets in the package. A notch 35 is provided in a side edge of sheets 16,18 part way through seal 24 to facilitate tearing the sheets 16,18 to remove the lower portion of the package after it is loaded into a magazine.

Leader 14 has first and second end edges 34,36 that are generally parallel to each other and edge 36 is shorter than edge 34. The leader also has side edges 38,40 that are perpendicular to edge 34 and extend a short distance toward edge 36. More specifically, the length of edges 38,40 is substantially equal to the width of seal line 22. Leader 14 also includes side edges 42,44 that extend from edges 38 and 40 and taper inwardly as the approach edge 36 of the leader. Thus, the width of the leader between side edges 42,44 is less than the width of the edge 34 of the leader.

Figure 2:
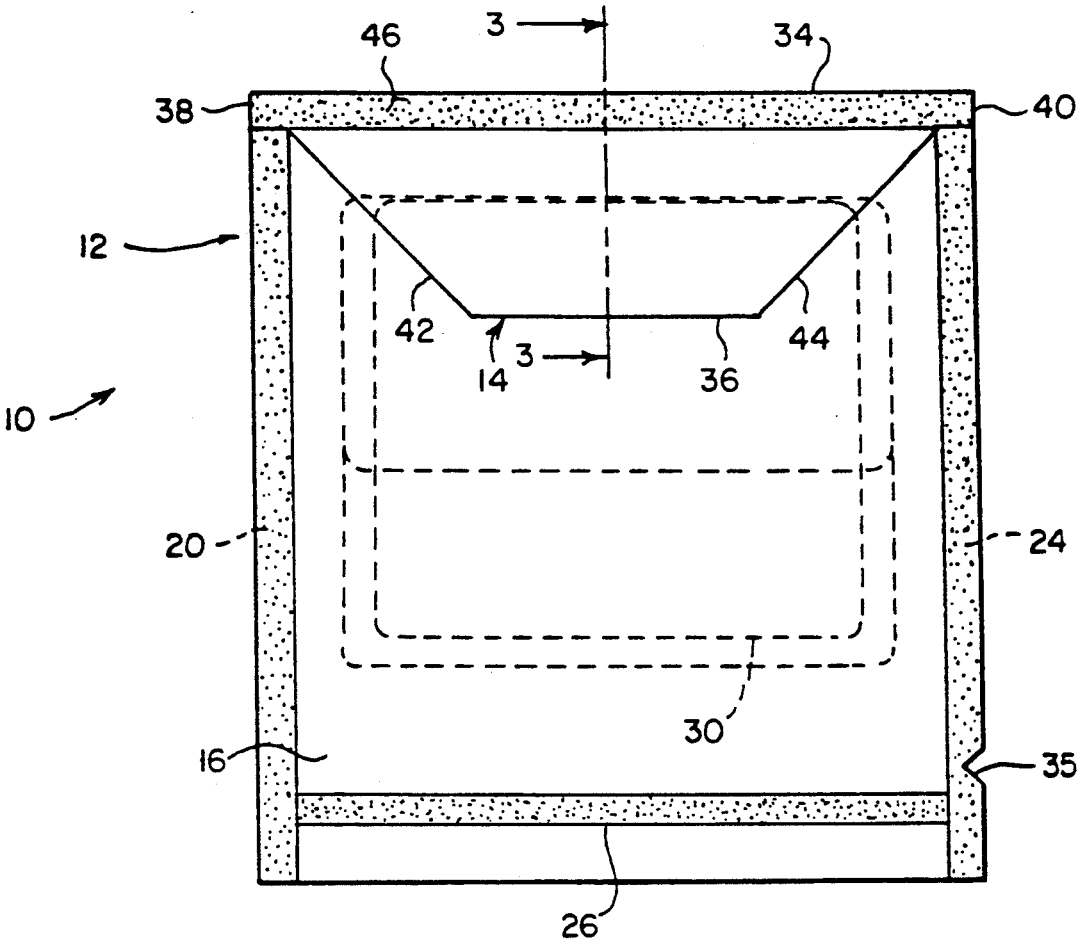
FIG. 2 is a plan view of the package after attachment of the leader and loading of the stack of film and carrier into the package.

After the seals 20, 22 and 24 of the pouch 10 are formed, leader 14 is placed over the top or upper face of sheet 16 as illustrated in FIG. 2 with the strip portion of the leader defined by edge 34 and side edges 38,40 overlying the seal 22. Then the leader is sealed to the pouch by a heat seal line shown at 46 in FIGS. 2 and 3. Heat seal line 46 does not extend into the portion of the leader defined by the tapered sides 42,44. Thus, the portion of the leader between heat seal 46 and edge 36 of the leader is completely unattached to the pouch so that it can be freely lifted from the upper face of sheet 16 and folded over the leading edge of the pouch, as shown in phantom in FIG. 3. This free and unattached portion of the leader can be connected to a spindle or other apparatus used for pulling the packaging material away from the stack of sheets in the carrier board once the package is located in a magazine or the like.

Due to the manner in which the leader is attached to the pouch, the leader remains in the position shown in FIG. 2 and in solid lines FIG. 3 during final assembly and leading of the package with film, and during shipment and installation into a magazine. In other words, the natural position of the leader is over the top of the upper face of sheet 16 of the pouch rather than extending away from the pouch. Thus the package fits neatly within a rectangular shaped bin adapted to hold a number of the empty packages and then loads them with film and carrier sheets. Even if the leader is accidentally lifted from the face of the sheet 16, it immediately returns into contact with the sheet when the leader is released. In addition, this attachment of the leader to the pouch avoids the need for adhesive tape or the like commonly used for holding the free end of a leader in a folded position over the top of a pouch in a film package. Another advantage of the package of the invention is that it is simple to fabricate and eliminates the need for folding of leaders about the pouch, as in some prior art packages, and also eliminates some lines of heat sealing required by prior packages.

Figure 4:
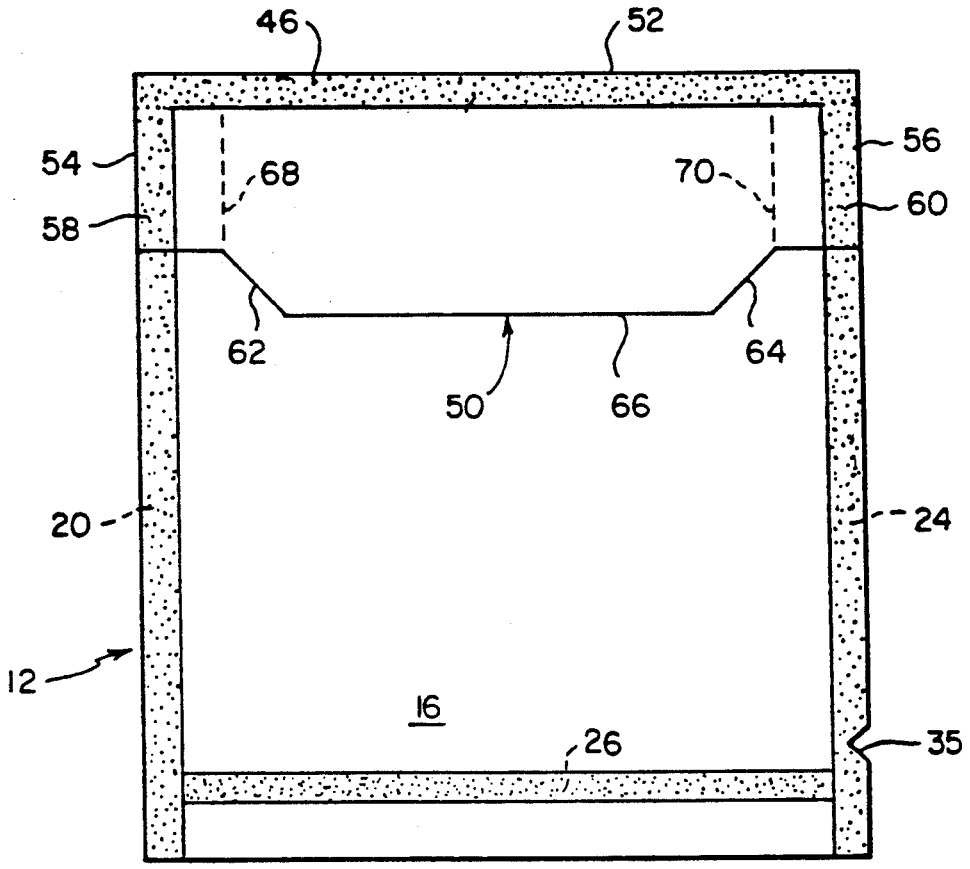
FIG. 4 is a view similar to FIG. 2 but illustrating a package with a different leader construction.

FIG. 4 illustrates another embodiment of the invention having a leader, generally designated 50, of a different construction. More specifically, the leader 50, like leader 14, is positioned entirely over the upper face of pouch 12, and only over the upper face. The leader 50 has an upper edge 52 that is positioned over the leading edge of pouch 12 and two side edges 54,56 which are perpendicular to edge 52 and extend along the side edges of the pouch 12 and along the upper face of sheet 16 of the pouch. Edges 54,56 are substantially longer than edges 38,40 of leader 14 and they extend a distance substantially greater than the heat seal line 22 (FIG. 1) which secures the sheets 16,18 together. Therefore, the leader adjacent the side edges 54,56 is secured to the pouch by lines of heat sealing designated 58,60, such lines of heat sealing extending downwardly from the heat seal line 46 that attaches the upper edge of the leader to the pouch.

Leader 50 also includes tapered side edges 62,64 that extend from the wider upper portion of the leader downwardly toward the bottom of the package and terminate at an edge 66 of the leader which is generally parallel to edge 52 of the leader. Thus the portion of the pouch defined by edges 62, 64 and 66 are completely free of the pouch, i.e., they are not sealed to the pouch.

Two rows of perforations 68,70 are provided in the leader 50 between seals 58,60 and adjacent to the seals. These rows of perforations extend from the heat seal line 46 to the end of the tapered edges 62,64 of the leader. Thus, when the package is placed in a magazine and the portion of the leader at and adjacent the edge 66 is to be secured to a spindle or the like, the edge 66 is grasped by an operator and pulled upwardly as viewed in FIG. 4, thereby causing the leader to tear along the rows of perforations 68,70. Then the leader is placed in the spindle as described hereinbefore for leader 14.

The embodiment illustrated in FIG. 4 has the same advantages as the package illustrated in FIGS. 1-3. In addition, the FIG. 4 embodiment firmly secures side edge portions of the leader to the upper face of the package in a manner which prevents the leader from being inadvertently displaced upwardly from its position in contact with the upper face of the sheet 16 of the pouch.

The invention has been described in detail with particular reference to preferred embodiments thereof, but it will be understood that variations and modifications can be effected within the spirit and scope of the invention.

I claim:

1. A package for enclosing a plurality of sheets of photosensitive material, the package comprising:

a pouch capable of receiving a plurality of sheets of a photosensitive material, the pouch having a first face and second face located in generally parallel planes, said first and second faces each having an inner surface and an outer surface, and means sealing the faces together so as to form a light tight space for receiving and completely surrounding and sealing a plurality of sheets of a photosensitive material placed within the pouch, the pouch having a leading edge, a bottom edge, and first and second side edges extending between the leading edge and bottom edge, and a leader positioned entirely over the outer surface of the first face of the pouch, the leader having a first edge secured to the leading edge of the pouch and other portions of the leader being free from the first face of the pouch so that the other portions of the leader can be lifted from the pouch for removal of the sheets of a photosensitive material from the pouch through an opening provided in the pouch at the end opposite said leading edge by pulling the leader in a direction substantially parallel to the said planes in which the first and second faces lie and away from the bottom edge.

2. A package for enclosing a plurality of sheets of photosensitive material, the package comprising:

a pouch capable of receiving a plurality of sheets of a photosensitive material, the pouch having a first face and second face located in generally parallel planes, said first and second faces each having an inner surface and an outer surface, and means sealing the faces together so as to form a light tight space for receiving and completely surround and sealing a plurality of sheets of a photosensitive material placed within the pouch, the pouch having a leading edge, a bottom edge, and first and second side edges extending between the leading edge bottom edge, and a leader positioned over the outer surface of the first face only of the pouch, the leader having a first edge secured to the leading edge of the pouch and other portions of the leader being free from the first face of the pouch so that the other portions of the leader can be lifted from the pouch for removal of the sheets of a photosensitive material from the pouch through an opening provided in the pouch at the end opposite said leading edge by pulling the leader in a direction substantially parallel to the said planes in which the first and second faces lie and away from the bottom edge.

3. A package containing a plurality of sheets of photosensitive material, the package comprising:

a pouch for holding the plurality of sheets of a photosensitive material, the pouch having a first face and second face located in generally parallel planes, said first and second faces each having an inner surface and an outer surface, and means sealing the faces together so as to form a light tight space to completely enclose the plurality of sheets of photosensitive material placed within the pouch, the pouch having a leading edge, a bottom edge, and first and second side edges extending between the leading edge and bottom edge, and a leader positioned over the outer surface of the first face only of the pouch, the leader having a first edge secured to the leading edge of the pouch and other portions of the leader being free from the first face of the pouch so that the other portions of the leader can be lifted from the pouch for removal of the sheets of a photosensitive material from the pouch through an opening provided in the pouch at the end opposite said leading edge by pulling the leader in a direction substantially parallel to the said planes in which the first and second faces lie and away from the bottom edge.

4. A package as set fort in claim 3 wherein the leader has side edges extending from the first edge of the leader, the width of the leader between the side edges being less than the width of the first edge of the leader.

5. A package as set forth in claim 4 wherein the side edges of the leader taper inwardly from the first edge of the leader.

6. A package for enclosing a plurality of sheets of photosensitive material, the package comprising:

a pouch capable of receiving a plurality of sheets of a photosensitive material, the pouch having a first face and second face located in generally parallel planes, said first and second faces each having an inner surface and an outer surface, and means sealing the faces together so as to form a light tight space for receiving and completely surrounding and sealing a plurality of sheets of photosensitive material within the pouch, the pouch having a leading edge, a bottom edge, and first and second side edges extending between the leading edge and bottom edge, and a leader positioned over the outer surface of the first face only of the pouch, the leader having a first edge secured to the leading edge of the pouch, the leader having two side edges substantially perpendicular to the first edge, the side edges of the leader being secured to the sides edges of the pouch and the other portions of the leader between the side edges being free from the first face of the pouch so that it can be lifted from the pouch for removal of the sheets of photosensitive material from the pouch through an opening provided in the pouch at the end opposite said leading edge by pulling the leader in a direction substantially parallel to the said planes in which the first and second faces lie and away from the bottom edge, the leader further comprising two rows of perforations between the side edges of the leader so that the leader can be pulled away from the pouch by tearing the leader along the row the perforations.

* * * * *